US011421866B1

(12) United States Patent
Balliet

(10) Patent No.: US 11,421,866 B1
(45) Date of Patent: Aug. 23, 2022

(54) SOCIAL DISTANCE LIGHTING SYSTEM

(71) Applicant: Kenneth Balliet, Wind Gap, PA (US)

(72) Inventor: Kenneth Balliet, Wind Gap, PA (US)

( * ) Notice: Subject to any disclaimer, the term of this patent is extended or adjusted under 35 U.S.C. 154(b) by 0 days.

(21) Appl. No.: 17/335,189

(22) Filed: Jun. 1, 2021

(51) Int. Cl.

| | |
|---|---|
| ***F21V 23/00*** | (2015.01) |
| ***F21V 23/04*** | (2006.01) |
| ***H05B 47/19*** | (2020.01) |
| ***H05B 45/20*** | (2020.01) |
| ***F21V 3/00*** | (2015.01) |
| *F21W 111/00* | (2006.01) |
| *F21Y 115/10* | (2016.01) |
| *F21Y 115/30* | (2016.01) |

(52) U.S. Cl.
CPC ..... *F21V 23/0435* (2013.01); *F21V 3/00* (2013.01); *H05B 45/20* (2020.01); *H05B 47/19* (2020.01); *F21W 2111/00* (2013.01); *F21Y 2115/10* (2016.08); *F21Y 2115/30* (2016.08)

(58) Field of Classification Search
CPC ..... F21V 23/0435; F21V 3/00; H05B 45/20; G01C 21/206
See application file for complete search history.

(56) References Cited

U.S. PATENT DOCUMENTS

| | | | | |
|---|---|---|---|---|
| 6,140,921 | A | 10/2000 | Baron | |
| 7,182,040 | B2 | 2/2007 | Pharo | |
| 8,674,848 | B2 | 3/2014 | Eggleton | |
| 9,237,634 | B2 | 1/2016 | Knibbe | |
| 9,715,800 | B2 | 7/2017 | Boullery | |
| 9,754,466 | B2 | 9/2017 | Simmons | |
| 9,824,551 | B2 | 11/2017 | Barboni | |
| 2010/0250381 | A1 | 9/2010 | Snyder | |
| 2014/0122018 | A1 | 5/2014 | Sundholm | |
| 2016/0005185 | A1* | 1/2016 | Geissler | G01S 5/163 348/47 |
| 2016/0049053 | A1* | 2/2016 | Simmons | G08B 7/066 340/815.4 |
| 2016/0123741 | A1* | 5/2016 | Mountain | G08B 7/066 701/533 |
| 2019/0003136 | A1* | 1/2019 | Kimura | B60Q 1/04 |
| 2020/0331146 | A1* | 10/2020 | Vu | B25J 19/06 |

FOREIGN PATENT DOCUMENTS

| | | |
|---|---|---|
| WO | 2014152998 | 9/2014 |

OTHER PUBLICATIONS

"LED Ultra Dance Floor" https://web.archive.org/web/20201203162400/https://www.sparkrentals.ca/led-flash-ultra-dance-floor.html (Dec. 3, 2020) (Year: 2020).*

* cited by examiner

*Primary Examiner* — Gerald J Sufleta, II
(74) *Attorney, Agent, or Firm* — Kyle A. Fletcher, Esq.

(57) ABSTRACT

The social distance lighting system generates an illuminated image. The social distance lighting system is configured for use with the floor of a chamber. The floor is the inferior horizontally oriented supporting surface of the chamber. The illuminated image projected by the social distance lighting system presents indicia on the floor of the chamber. The indicia presented by the social distance lighting system generates a sentiment that marks the boundaries and center points that allow people to maintain a proper social distance. The social distance lighting system comprises a lamp, a plurality of LEDs, and a remote control. The plurality of LEDs mount in the lamp. The plurality of LEDs generate the illuminated image. The remote control controls the operation of the plurality of LEDs.

17 Claims, 5 Drawing Sheets

SOCIAL DISTANCE LIGHTING SYSTEM

TITLE OF INVENTION

Social Distance Lighting System

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of illuminated display means for floors, walls, and similar surfaces.

SUMMARY OF INVENTION

The social distance lighting system generates an illuminated image. The social distance lighting system is configured for use with the floor of a chamber. The floor is the inferior horizontally oriented supporting surface of the chamber. The illuminated image projected by the social distance lighting system presents indicia on the floor of the chamber. The indicia presented by the social distance lighting system generates a sentiment that marks the boundaries and center points that allow people to maintain a proper social distance. The social distance lighting system comprises a lamp, a plurality of LEDs, and a remote control. The plurality of LEDs mount in the lamp. The plurality of LEDs generate the illuminated image. The remote control controls the operation of the plurality of LEDs.

These together with additional objects, features and advantages of the social distance lighting system will be readily apparent to those of ordinary skill in the art upon reading the following detailed description of the presently preferred, but nonetheless illustrative, embodiments when taken in conjunction with the accompanying drawings.

In this respect, before explaining the current embodiments of the social distance lighting system in detail, it is to be understood that the social distance lighting system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the social distance lighting system.

It is therefore important that the claims be regarded as including such equivalent construction insofar as they do not depart from the spirit and scope of the social distance lighting system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
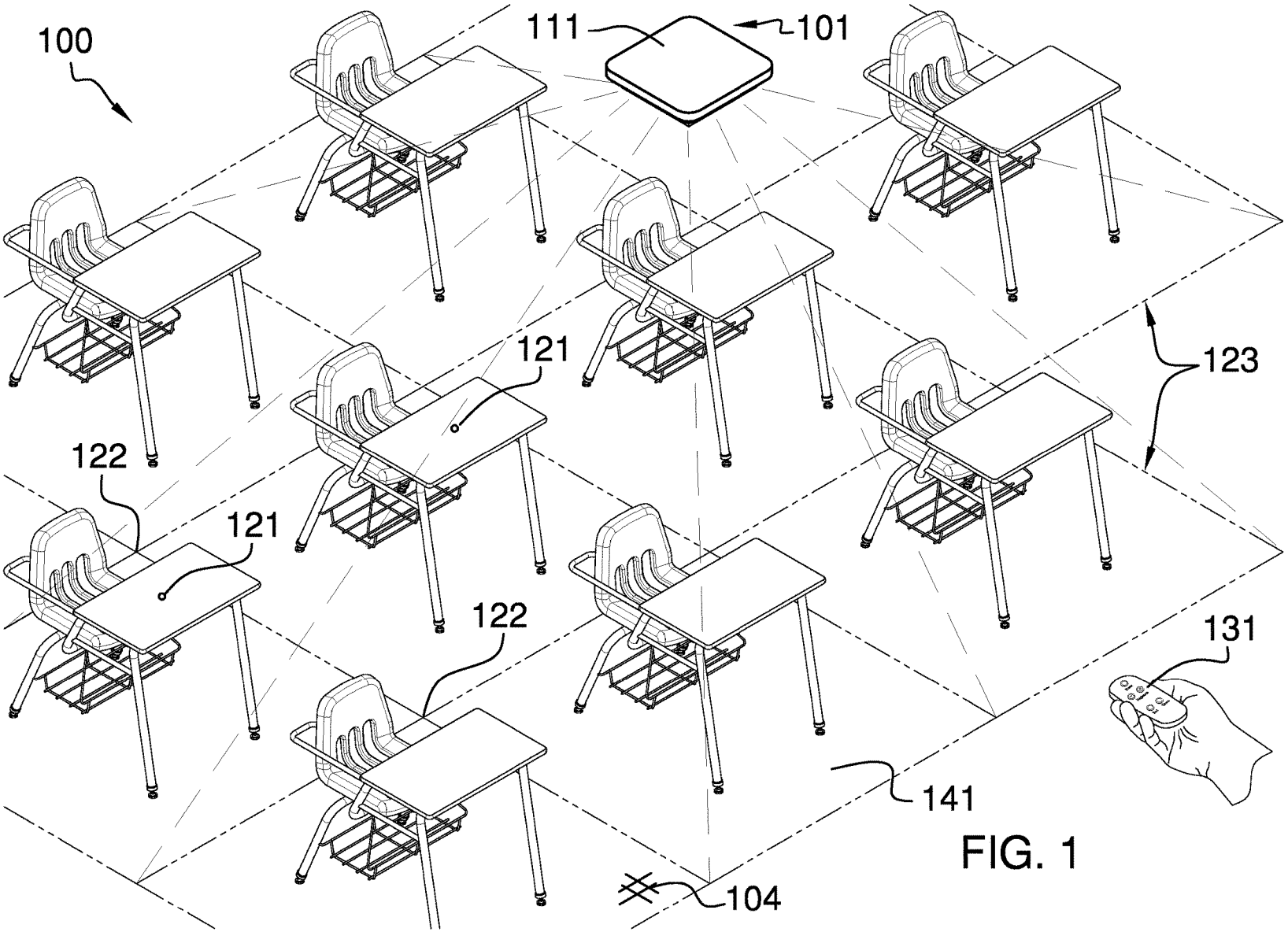
FIG. 1 is a perspective view of an embodiment of the disclosure.
Figure 2:
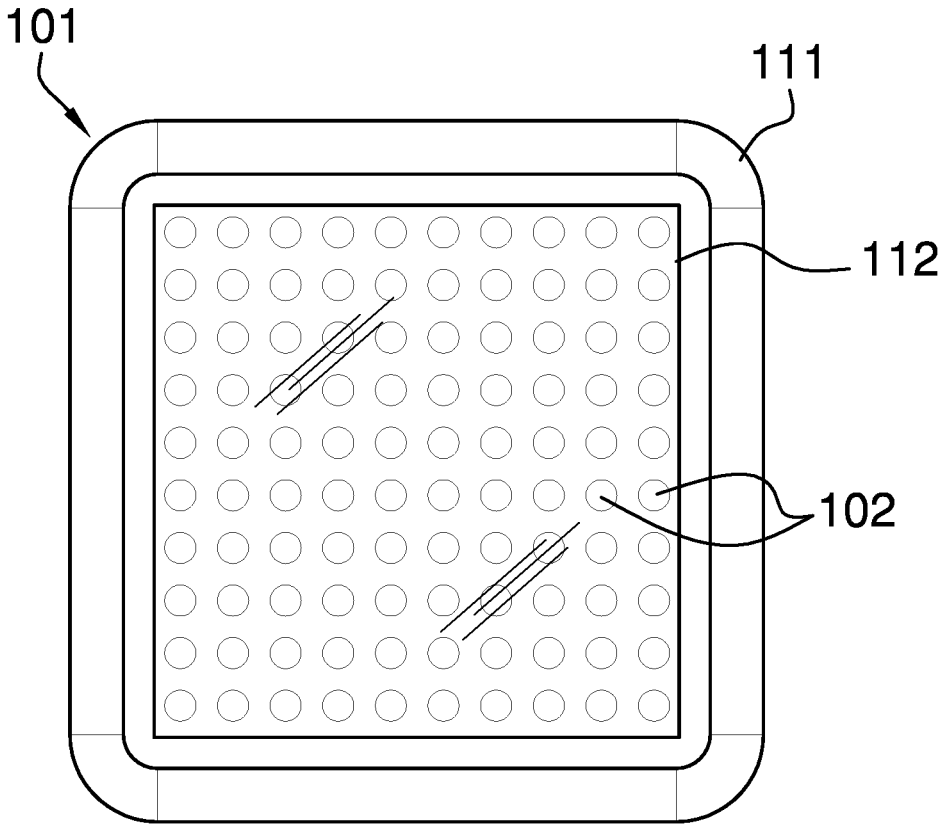
FIG. 2 is a bottom view of an embodiment of the disclosure.
Figure 3:
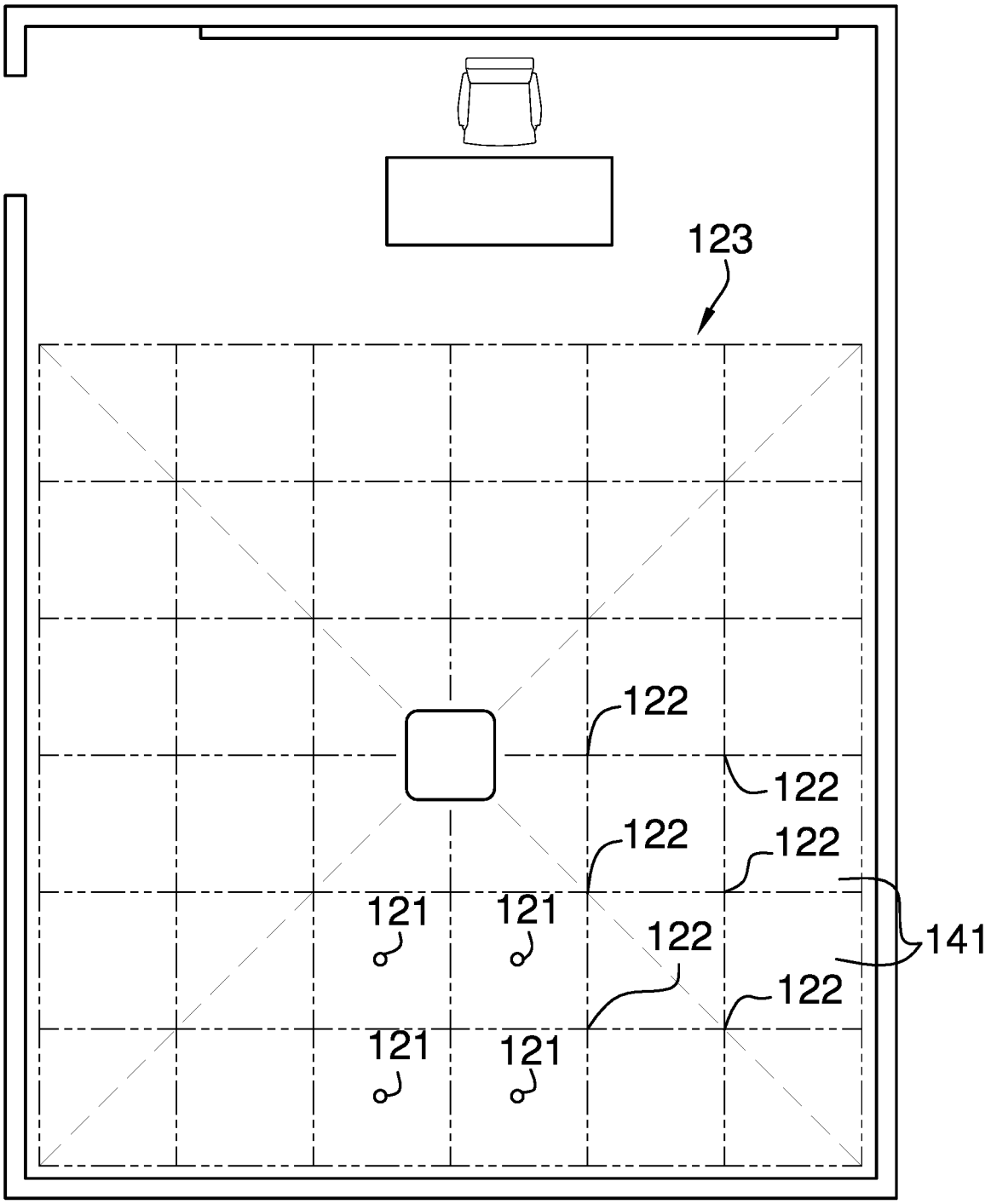
FIG. 3 is a top view of an embodiment of the disclosure.
Figure 4:
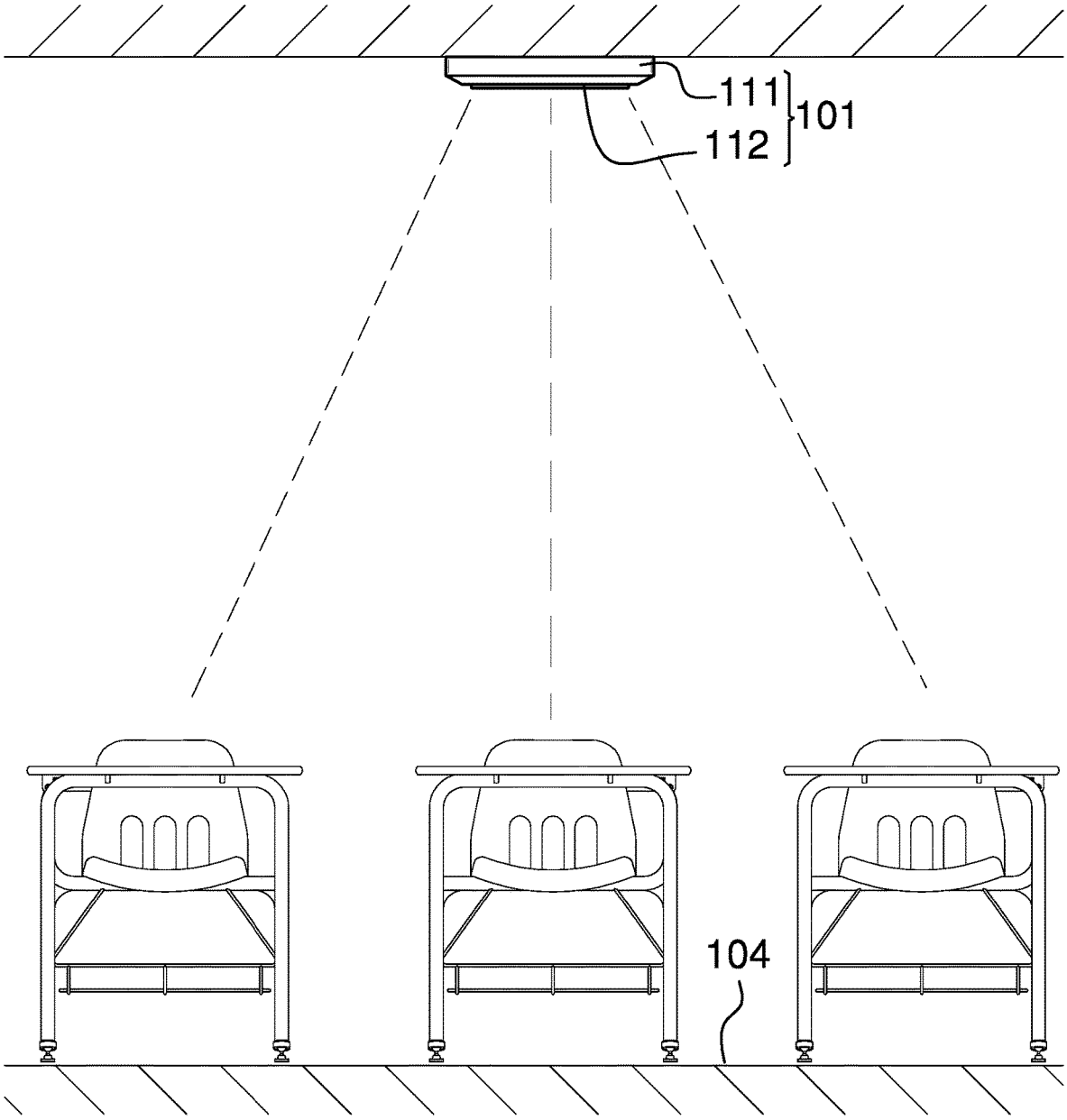
FIG. 4 is a front view of an embodiment of the disclosure.
Figure 5:
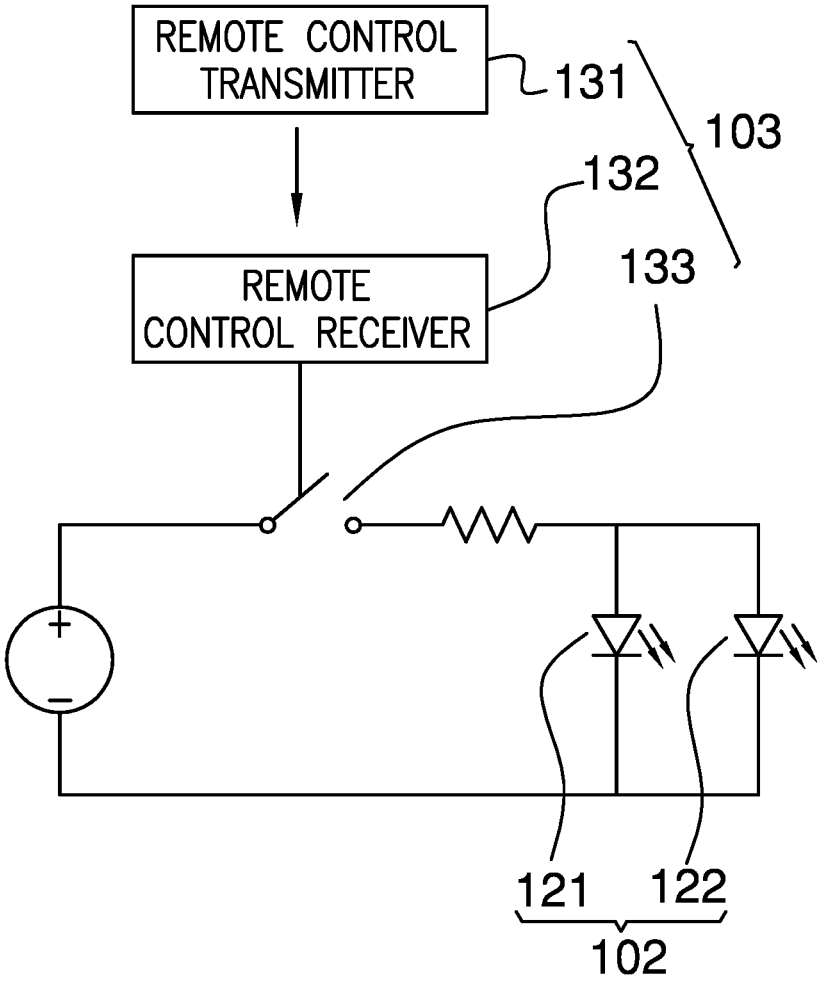
FIG. 5 is a schematic view of an embodiment of the disclosure.

Detailed reference will now be made to one or more potential embodiments of the disclosure, which are illustrated in FIGS. 1 through 5.

The social distance lighting system 100 (hereinafter invention) generates an illuminated image 123. The invention 100 is configured for use with a floor of a chamber 104. The floor is the inferior horizontally oriented supporting surface of the chamber. The illuminated image 123 projected by the invention 100 presents indicia on the floor of a chamber 104. The indicia presented by the invention 100 generates a sentiment that marks the boundaries and center points that allow people to maintain a proper social distance. The invention 100 comprises a lamp 101, a plurality of LEDs 102, and a remote control 103. The plurality of LEDs 102 mount in the lamp 101. The plurality of LEDs 102 generate the illuminated image 123. The remote control 103 controls the operation of the plurality of LEDs 102.

The lamp 101 is the physical structure that contains the plurality of LEDs 102. The lamp 101 mounts on a surface in the chamber. The lamp 101 directs the illuminated image 123 generated by the invention 100 towards the floor of a chamber 104. The lamp 101 comprises a lamp 101 housing 111 and a lamp 101 lens 112. The lamp 101 lens 112 mounts on the lamp 101 housing 111.

The lamp 101 housing 111 is a rigid structure. The lamp 101 housing 111 contains the plurality of LEDs 102. The lamp 101 housing 111 is formed with all apertures and form factors necessary to allow the lamp 101 housing 111 to accommodate the use and operation of the plurality of LEDs 102. Methods to form a lamp 101 housing 111 suitable for the purposes described in this disclosure are well-known and documented in the mechanical arts.

The lamp 101 lens 112 is a transparent protective cover that encloses the lamp 101 housing 111. The lamp 101 lens 112 protects the plurality of LEDs 102 mounted in the lamp 101 housing 111. The transparent nature of the lamp 101 lens 112 allows the illuminated image 123 to be projected through the lamp 101 lens 112.

Each of the plurality of LEDs 102 is an electrically powered device. Each of the plurality of LEDs 102 converts electric energy into electromagnetic radiation. The electromagnetic radiation generated by the plurality of LEDs 102 is directed by the lamp 101 towards the floor of a chamber 104. The electromagnetic radiation generated by the plurality of LEDs 102 forms the illuminated image 123 that is displayed on the floor of a chamber 104. Each of the plurality of LEDs 102 is a laser. The frequency of electromagnetic radiation generated by the plurality of LEDs 102 is selected from the group consisting of a first hue and a second hue. The first hue is visibly distinct from the second hue. The plurality of LEDs 102 comprises a plurality of centering LEDs 121, a plurality of boundary LEDs 122, and an illuminated image 123.

Each of the plurality of boundary LEDs 122 is an electrically powered device. Each of the plurality of boundary LEDs 122 converts electric energy into electromagnetic radiation. Each of the plurality of boundary LEDs 122 forms a portion of the illuminated image 123 that is displayed on the floor of a chamber 104. The hue selected for each of the plurality of boundary LEDs 122 is identical. The hue selected for each of the plurality of boundary LEDs 122 is the first hue. The illumination generated by the plurality of boundary LEDs 122 marks the boundaries of each cell contained within the grid display 141 formed by the illuminated image 123. Each cell formed by the illumination of the plurality of boundary LEDs 122 defines the space allocated to one socially distanced individual.

Each of the plurality of centering LEDs 121 is an electrically powered device. Each of the plurality of centering LEDs 121 converts electric energy into electromagnetic radiation. Each of the plurality of centering LEDs 121 forms a portion of the illuminated image 123 that is displayed on the floor of a chamber 104. The hue selected for each of the plurality of centering LEDs 121 is identical. The hue selected for each of the plurality of centering LEDs 121 is the second hue. The illumination generated by the plurality of centering LEDs 121 marks the center of each cell contained within the grid display 141 formed by the illuminated image 123.

The illuminated image 123 is the image that is formed by the plurality of LEDs 102. The electromagnetic radiation generated by the illuminated image 123 forms a plurality of illuminated points of light on the floor of a chamber 104. Each point of light generated by the illuminated image 123 forms an indicia.

In the first potential embodiment of the disclosure, the illuminated points that form the illuminated image 123 generate a sentiment that comprises a grid display 141. The grid display 141 divides the floor of a chamber 104 into a set of cells. Each cell formed by the grid display 141 demarcates the available socially distanced spaces available to the occupants standing on the floor of a chamber 104. The points of illumination generated by the plurality of boundary LEDs 122 mark the boundaries of each cell formed by the grid display 141. The points of illumination generated by the plurality of centering LEDs 121 mark the center of each cell of the grid display 141.

The remote control 103 controls the operation of the plurality of LEDs 102. The remote control 103 is an electrically powered device. The remote control 103 remotely controls the operation of the plurality of LEDs 102. By remotely control is meant that an individual can control the illumination of the plurality of LEDs 102 without being in reach of the plurality of LEDs 102. The remote control 103 further comprises an RC transmitter 131, an RC receiver 132, and an RC relay 133.

The RC transmitter 131 is a radio frequency transmitter. The transmitter is defined elsewhere in this disclosure. The RC transmitter 131 transmits a radio frequency signal to the RC receiver 132 that allows the plurality of LEDs 102 to be operated remotely.

The RC receiver 132 is a radio frequency receiver. The receiver is defined elsewhere in this disclosure. The RC receiver 132 receives the radio signal transmitted by the RC transmitter 131. The RC receiver 132 controls the operation of the RC relay 133. By controlling the operation of the RC relay 133 is meant that the RC receiver 132: a) actuates the RC relay 133 from an open position to a closed position when RC receiver 132 receives an initial radio frequency signal from the RC transmitter 131; and, b) actuates the RC receiver 132 from the closed position to the open position when RC receiver 132 receives a subsequent radio frequency signal from the RC transmitter 131. The RC receiver 132 alternates the actuation of the position RC relay 133 between the open position and the closed position on the receipt of each subsequent radio frequency transmission received from the RC transmitter 131.

The RC relay 133 is an electrically controlled switch. The RC receiver 132 electrically controls the operation of the RC relay 133. The RC relay 133 physically controls the illumination of the plurality of LEDs 102. The RC relay 133 is actuated to the closed position to allow the flow of electricity through the plurality of LEDs 102. The RC relay 133 illuminates the plurality of LEDs 102 when actuated to the closed position. The RC relay 133 is actuated to the open position to discontinue the flow of electricity through the plurality of LEDs 102. The RC relay 133 extinguishes the plurality of LEDs 102 when actuated to the open position.

The following definitions were used in this disclosure:

Ceiling: As used in this disclosure a ceiling refers to either: 1) the superior horizontal surface of a chamber that is distal from the floor; 2) the superior horizontal surface of a structure; or, 3) the upper limit of a range. A floor and a ceiling can refer to the same structure wherein the selection depends solely on the point of view of the user. The selection of this definition depends on the context. In situations where the context is unclear the first definition should be used.

Chamber: As used in this disclosure, a chamber is an enclosed or enclosable space within a building.

Color: As used in this disclosure, a color refers to the visible portion of the spectrum that is reflected off of an object that is exposed to an external source of electromagnetic radiation. A color is often referred to as a shade.

Color Spectrum: As used in this disclosure, a color spectrum refers to organization of ranges visible electromagnetic radiation into specific colors. Within this disclosure: a) electromagnetic radiation with wavelengths of 380 nm to 450 nm are called violet; b) electromagnetic radiation with wavelengths of 450 nm to 485 nm are called blue; c) electromagnetic radiation with wavelengths of 485 nm to 500 nm are called cyan; d) electromagnetic radiation with wavelengths of 500 nm to 565 nm are called green; e) electromagnetic radiation with wavelengths of 565 nm to 590 nm are called yellow; f) electromagnetic radiation with wavelengths of 590 nm to 625 nm are called orange; and, g) electromagnetic radiation with wavelengths of 625 nm to 740 nm are called red.

Diode: As used in this disclosure, a diode is a two terminal semiconductor device that allows current flow in only one direction. The two terminals are called the anode and the cathode. Electric current is allowed to pass from the anode to the cathode.

Electromagnetic Radiation: As used in this disclosure, electromagnetic radiation refers to an interaction between electric fields and magnetic fields that is capable of transmitting energy through a vacuum.

Extinguish: As used in this disclosure, to extinguish means to cause a device to stop generating an illumination.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Grid: As used in this disclosure, a grid is a network of intersecting parallel and perpendicular lines. The rectangular space within a grid that is bounded by two adjacent parallel lines and two adjacent parallel lines is called a cell.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Housing: As used in this disclosure, a housing is a rigid structure that encloses and protects one or more devices.

Hue: As used in this disclosure, a hue refers to a specific color.

Inferior: As used in this disclosure, the term inferior refers to a directional reference that is parallel to and in the same direction as the force of gravity when an object is positioned or used normally.

Illumination: As used in this disclosure, illumination refers to electromagnetic radiation contained with an area. Illumination is a synonym for light, particularly in cases where a measure of the amount of visible electromagnetic radiation in a space is called for. The verb form of illumination is to illuminate and is taken to mean the generation of an illumination.

Image: As used in this disclosure, an image is an optical representation or reproduction of an indicia or of the appearance of something or someone. See indicia sentiment optical character recognition. See Label.

Indicia: As used in this disclosure, the term indicia refers to a set of markings that identify a sentiment. See sentiment.

Lamp: As used in this disclosure, a lamp is a two terminal electrical device that generates (typically visible spectrum) electromagnetic radiation.

Laser: As used in this disclosure, a laser is an electrical device used to generate monochromatic electromagnetic radiation. By monochromatic is meant that the generated photons forming the electromagnetic radiation all have the same wavelength.

LED: As used in this disclosure, an LED is an acronym for a light emitting diode. A light emitting diode is a diode that is also a light source.

Lens: As used in this disclosure, a lens is a transparent substance through which electromagnetic radiation can pass. The lens refracts the electromagnetic radiation as it passes through the lens. A lens may or may not be formed with curved surfaces that are used to concentrate or disperse the electromagnetic radiation that travels through the lens. A lens can also project a focused image on a surface known as a virtual image. A lens may also be used to change the apparent size of the virtual image. A magnifying lens (also known as a magnifying glass) is a lens that increases the apparent size of a virtual image.

Light: As used in this disclosure, light refers to electromagnetic radiation that illuminates an area. Illumination is a synonym for light, particularly in cases where a measure of the amount of light in a space is called for.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Microorganism: As used in this disclosure, a microorganism is an organism too small to be viewed by the unaided eye. Microorganisms are typically single celled organisms such as bacteria, yeast, viruses, protozoa, fungi and algae. A pathogen refers to a microorganism that has the potential to cause illness or disease.

Radiation: As used in this disclosure, radiation refers to the discharge of energy from an object. The term is often applied to energy in the form of: a) waves, such as electromagnetic radiation or acoustic energy; b) nuclear radiation such as alpha, beta, and gamma, particle radiation; and, c) gravitational waves. The radiation of electromagnetic waves is often classified by the wavelength of the generated waves, such as ultraviolet and infrared radiation.

Radio Frequency: As used in this disclosure, a radio frequency refers to electromagnetic radiation that is propagated in a spectrum ranging from 10 KHz to 1 THz.

Receiver: As used in this disclosure, a receiver is an electric device that is used to receive and demodulate electromagnetic radiation such as radio signals.

Relay: As used in this disclosure, a relay is an automatic electronic, electromagnetic or electromechanical device that reacts to changes in voltage or current by opening or closing a switch in an electric circuit. Relays are further defined with a coil and a switch. Applying a voltage to the coil, usually referred to as energizing the coil, will cause the coil to change the position of the switch. This definition is not intended to preclude the substitution of a transistor for a relay. Within this disclosure, a transistor can be considered as a relay. In this scenario, the base voltage is analogous to the coil of the relay and the current flow from the collector to the emitter is analogous to the operation of the switch of the relay. Those skilled in the electrical arts will recognize that this substitution can be made without undue experimentation. The transistor is defined in greater detail elsewhere in this disclosure.

Remote Control: As used in this disclosure, remote control means the establishment of control of a device from a distance. Remote control is generally accomplished through the use of an electrical device that generates electrically based control signals that are transmitted via radio frequencies or other means to the device.

Sentiment: As used in this disclosure, a sentiment refers to a symbolic meaning or message that is communicated through the use of an image, potentially including a text based image.

Social Distance: As used in this disclosure, a social distance refers to a minimum span of distance between a first person and a second person that is maintained to inhibit the transmission of a communicable pathogen from the first person and the second person. The term social distancing refers to the practice of maintaining a social distance between the first person and the second person.

Transistor: As used in this disclosure, a transistor is a general term for a three terminal semiconducting electrical device that is used for electrical signal amplification and electrical switching applications. There are several designs of transistors. A common example of a transistor is an NPN transistor that further comprises a collector terminal, an emitter terminal, and a base terminal and which consists of a combination of two rectifying junctions (a diode is an example of a rectifying junction). Current flowing from the collector terminal through the emitter terminal crosses the two rectifier junctions. The amount of the electric current crossing the two rectified junctions is controlled by the amount of electric current that flows through the base terminal. This disclosure assumes the use of an NPN transistor. This assumption is made solely for the purposes of simplicity and clarity of exposition. Those skilled in the electrical arts will recognize that other types of transistors, including but not limited to, field effect transistors and PNP transistors, can be substituted for an NPN transistor without undue experimentation.

Transmitter: As used in this disclosure, a transmitter is a device that is used to generate and transmit electromagnetic radiation such as radio signals.

Transparent: As used in this disclosure, transparent refers to a material that allows light to pass through the material without significant scattering such that an object can be clearly seen through the material.

Spectrum: As used in this disclosure, a spectrum refers to the distribution and amplitude of the component frequencies of a source of electromagnetic radiation. Spectrums are typically organized and displayed by frequency or frequency range.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Visible Light: As used in this disclosure, visible light refers electromagnetic radiation with a wavelength in the approximate range of 400 nanometers to 800 nanometers.

Wall: As used in this disclosure, a wall is a vertical surface that forms a boundary of a room or chamber.

Wave: As used in this disclosure, a wave is a mechanism capable of transferring energy without transferring mass. Specifically, a wave refers to a transfer of momentum or energy through an object or medium such that there is no significant change in the relative positions of the particles (or molecules) that make up the object or medium.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A social distance lighting system comprising
a lamp, a plurality of LEDs, and a remote control;
wherein the plurality of LEDs mount in the lamp;
wherein the remote control controls the operation of the plurality of LEDs;
wherein the social distance lighting system generates an illuminated image;
wherein the social distance lighting system is configured for use with a floor of a chamber;
wherein the floor is an inferior horizontally oriented supporting surface of the chamber;
wherein the illuminated image generates a grid display;
wherein the grid display further comprises a plurality of cells;
wherein the illuminated image projected by the social distance lighting system presents indicia on the floor of the chamber;
wherein the indicia presented by the social distance lighting system marks boundaries and center points of the cells formed by the grid display;
wherein the plurality of LEDs comprises a plurality of centering LEDs, a plurality of boundary LEDs;
wherein each of the plurality of boundary LEDs forms a portion of the illuminated image that is displayed on the floor of the chamber;
wherein each of the plurality of centering LEDs forms a portion of the illuminated image that is displayed on the floor of the chamber.

2. The social distance lighting system according to claim 1
wherein the plurality of LEDs generate the illuminated image;

wherein the lamp is a physical structure that contains the plurality of LEDs;

wherein the lamp directs the illuminated image generated by the social distance lighting system towards the floor of the chamber.

3. The social distance lighting system according to claim 2 wherein each of the plurality of LEDs is an electrically powered device;

wherein each of the plurality of LEDs converts electric energy into electromagnetic radiation;

wherein the electromagnetic radiation generated by the plurality of LEDs is directed by the lamp towards the floor of the chamber;

wherein the electromagnetic radiation generated by the plurality of LEDs forms the illuminated image that is displayed on the floor of the chamber.

4. The social distance lighting system according to claim 3 wherein each of the plurality of LEDs is a laser.

5. The social distance lighting system according to claim 4 wherein the frequency of electromagnetic radiation generated by the plurality of LEDs is selected from the group consisting of a first hue and a second hue;

wherein the first hue is visibly distinct from the second hue.

6. The social distance lighting system according to claim 5 wherein the remote control controls the operation of the plurality of LEDs;

wherein the remote control is an electrically powered device;

wherein the remote control remotely controls the operation of the plurality of LEDs.

7. The social distance lighting system according to claim 6 wherein the lamp comprises a lamp housing and a lamp lens;

wherein the lamp lens mounts on the lamp housing.

8. The social distance lighting system according to claim 7 wherein the remote control further comprises an RC transmitter, an RC receiver, and an RC relay;

wherein the RC transmitter transmits a radio frequency signal to the RC receiver;

wherein the RC receiver controls the operation of the RC relay.

9. The social distance lighting system according to claim 8 wherein the lamp housing is a rigid structure;

wherein the lamp housing contains the plurality of LEDs;

wherein the lamp lens is a transparent protective cover that encloses the lamp housing;

wherein the lamp lens protects the plurality of LEDs mounted in the lamp housing;

wherein the transparent nature of the lamp lens allows the illuminated image to be projected through the lamp lens.

10. The social distance lighting system according to claim 9 wherein each of the plurality of boundary LEDs is an electrically powered device;

wherein each of the plurality of boundary LEDs converts electric energy into electromagnetic radiation;

wherein the hue selected for each of the plurality of boundary LEDs is identical;

wherein the hue selected for each of the plurality of boundary LEDs is the first hue.

11. The social distance lighting system according to claim 10 wherein each of the plurality of centering LEDs is an electrically powered device;

wherein each of the plurality of centering LEDs converts electric energy into electromagnetic radiation;

wherein the hue selected for each of the plurality of centering LEDs is identical;

wherein the hue selected for each of the plurality of centering LEDs is the second hue.

12. The social distance lighting system according to claim 11 wherein the illuminated image is the image that is formed by the plurality of LEDs;

wherein the electromagnetic radiation generated by the illuminated image forms a plurality of illuminated points of light on the floor of the chamber;

wherein each point of light generated by the illuminated image forms an indicia;

wherein the illuminated points that form the illuminated image generate the grid display.

13. The social distance lighting system according to claim 12 wherein the illumination generated by the plurality of boundary LEDs marks the boundaries of each cell contained within the grid display formed by the illuminated image;

wherein the illumination generated by the plurality of centering LEDs marks the center of each cell contained within the grid display formed by the illuminated image.

14. The social distance lighting system according to claim 13 wherein the points of illumination generated by the plurality of boundary LEDs mark the boundaries of each cell formed by the grid display;

wherein the points of illumination generated by the plurality of centering LEDs mark the center of each cell of the grid display.

15. The social distance lighting system according to claim 14 wherein the RC transmitter is a radio frequency transmitter;

wherein the RC receiver is a radio frequency receiver.

16. The social distance lighting system according to claim 15 wherein the RC receiver receives the radio frequency signal transmitted by the RC transmitter;

wherein the RC receiver actuates the RC relay from an open position to a closed position when RC receiver receives an initial radio frequency signal from the RC transmitter;

wherein the RC receiver actuates the RC receiver from the closed position to the open position when RC receiver receives a subsequent radio frequency signal from the RC transmitter;

wherein the RC receiver alternates the actuation of the position RC relay between the open position and the closed position on the receipt of each subsequent radio frequency transmission received from the RC transmitter.

17. The social distance lighting system according to claim 16 wherein the RC relay is an electrically controlled switch;

wherein the RC receiver electrically controls the operation of the RC relay;

wherein the RC relay physically controls the illumination of the plurality of LEDs;

wherein the RC relay is actuated to the closed position to allow the flow of electricity through the plurality of LEDs;

wherein the RC relay illuminates the plurality of LEDs when actuated to the closed position;

wherein the RC relay is actuated to the open position to discontinue the flow of electricity through the plurality of LEDs;

wherein the RC relay extinguishes the plurality of LEDs when actuated to the open position.

* * * * *